US005197516A

United States Patent [19]

Smietana

[11] Patent Number: 5,197,516

[45] Date of Patent: Mar. 30, 1993

[54] HYDRAULIC SERVO VALVE WITH CONTROLLED DISENGAGEMENT FEATURE

[75] Inventor: James M. Smietana, West Seneca, N.Y.

[73] Assignee: Moog Controls, Inc., East Aurora, N.Y.

[21] Appl. No.: 877,530

[22] Filed: May 1, 1992

[51] Int. Cl.[5] ..... F15B 13/043

[52] U.S. Cl. ..... 137/625.62; 137/625.64

[58] Field of Search ..... 137/625.62, 625.64

[56] References Cited

U.S. PATENT DOCUMENTS

| | | | |
|---|---|---|---|
| 3,078,863 | 11/1963 | Wolpin et al. . | |
| 3,221,760 | 12/1965 | Buchanan . | |
| 3,228,423 | 3/1966 | Moog, Jr. . | |
| 3,910,314 | 3/1975 | Nicholson . | |
| 4,041,983 | 8/1977 | Bianchetta | 137/625.66 X |
| 4,046,165 | 9/1977 | Rose et al. | 137/625.64 X |
| 4,185,660 | 1/1980 | Faix | 137/625.64 |
| 4,337,797 | 4/1982 | Caruso . | |
| 4,456,031 | 1/1984 | Taplin . | |
| 4,617,966 | 3/1986 | Nicholson . | |

*Primary Examiner*—Gerald A. Michalsky

*Attorney, Agent, or Firm*—Wall and Roehrig

[57] ABSTRACT

A hydraulic servo valve arangement of the type having a hydraulic amplifier followed by a spool type servo valve second stage, includes a deceleration control mechanism. A spindle-type positioner has first and second positions which respectively permit and block flow of fluid from the first amplifier stage to the first end of the second stage spool. The hydraulic actuator urges the positioner into its first position, and a spring urges the positioner into a second or closed position in the event a failure mode is encountered. A solenoid valve has a communicating port coupled through a dropping orifice to a source of fluid supply and a second port coupled to drain, such that in an actuated condition, input port is at high pressure but in an unactuated condition the input port drops to low pressure. Relief channels and in fluid communication with the one end of the spool member have metered orifices to limit the flow of hydraulic fluid when the spool transits to its null position. Relief passages in communication with the positioner piston have respective transit and null override orifices which achieve smooth movement of the positioner to push the spool member to its set position.

6 Claims, 7 Drawing Sheets

HYDRAULIC SERVO VALVE WITH CONTROLLED DISENGAGEMENT FEATURE

BACKGROUND OF THE INVENTION

The invention relates to hydraulic servo valves, and is more particularly concerned with servo valves for controlling high performance, high speed actuators of the type including a hydraulic amplifier first stage and a spool valve second stage. The invention is specifically directed to a servo valve which includes a deceleration control mechanism to prevent high acceleration, i.e., high forces, in the actuator served by the servo valve, in the event of servo failure or actuator failure.

Fluid control valves, to wit, hydraulic servo valves, are well known and many examples exist. One typical servo valve is described in U.S. Pat. No. 3,228,423. These valves are frequently used to control movement of a hydraulic actuator where precision control of movement and rapid response are required. These servo valves have good linearity of response, with output proportional to input over a wide range. In valves of this type, there is a first stage which comprises a so-called torque motor which controls a flapper situated between a pair of fluid jets, which are coupled to amplifier ports. Supply pressure and return or drain are connected to this first stage, and the torque motor controls the flapper such that there are differential pressures applied to the amplifier ports which are in proportion to the signal applied to the armature of the torque motor.

A spool type second stage comprises a valve body with suitable channeling and porting, a cylindrical sleeve or bushing with precision-cut ports and openings and a spool which travels back and forth in the bushing. The spool has lands and grooves on the cylindrical face so that the lands and the ports in the bushing define precision variable orifices that deliver flows in proportion to the amplifier outputs, to first and second control ports. The outputs at the amplifier ports are applied to the first and second ends of the spool to urge it right or left of a center or null position. In the null position the output pressures at the control ports are in balance.

An arm mechanically couples the spool to the flapper, and provides mechanical feedback to the first stage.

There are numerous variations in the basic design of the hydraulic servo valve, and some of these appear in U.S. Pats. Nos. 3,221,760; 4,617,966; and 4,456,031. A spool and bushing for a second stage is described in U.S. Pat. No. 4,337,797.

In the case of high-speed, high-performance actuators, it is desired to include a mechanism to limit acceleration of the controlled hydraulic actuator in the event of failure of the hydraulic amplifier stage or of control circuitry upstream of it. To accomplish this it is necessary to override the first stage and urge the spool of the second stage quickly, but smoothly, to a set point near its null position. The object here is to decelerate the actuator travel within a small portion of its throw or stroke length, but to do so in a fashion to limit acceleration or deceleration to an acceptable level, ideally to less than 0.4 g.

OBJECTS AND SUMMARY OF THE INVENTION

It is an object of this invention to provide a servo valve with a controlled disengagement mechanism, i.e., a so-called "abort valve" which gracefully brings the spool to its set position so as to permit descent of the controlled actuator at a deceleration that does not exceed a target maximum.

It is another object to provide a controlled disengagement mechanism which brings the servo valve spool to its set position without ringing or hunting.

It is yet another object to provide a controlled disengagement mechanism which brings the spool to its set position so as to minimize the travel time and displacement of the controlled actuator from the time a disengagement signal is initiated.

In accordance with an aspect of this invention, a deceleration control mechanism associated with a spool-type hydraulic servo valve is interposed on one side of the spool in the associated amplifier fluid channel that supplies fluid from the first stage to one end of the spool. In the deceleration control mechanism, there is a hydraulically actuated positioner, in a form of a piston, which is hydraulically biased into an open position, but spring biased into a closed position. The positioner has an amp port shutoff land which cooperates with an amplifier port for permitting and blocking the flow of fluid between the associated amplifier port and the end of the servo valve spool when the positioner is in its open and closed positions, respectively. A solenoid valve, which receives a control signal input has an input port coupled through a dropping orifice to a source of supply pressure and a second port that is coupled to the drain or return. In the actuated condition of the solenoid valve, the input port is at the supply pressure, but in the unactuated condition, the input port drops to low pressure. The positioner hydraulic actuator, which is preferably in the form of a piston, is in communication with the solenoid valve input port. When the solenoid valve is actuated, the piston or actuator biases the positioner open, so that the spool of the servo valve is connected directly to the fluid amplifier channel. However, when the solenoid valve is unactuated, the fluid pressure to the piston drops, and the biasing spring, which is of greater spring force than the force of the residual fluid pressure on the piston or actuator, urges the positioner to the closed position, and cuts off the amplifier channel from the spool of the servo valve.

There is at least one relief channel, and preferably a pair of relief channels, disposed in fluid communication with the associated end of the servo valve spool. These relief channels each have a metered orifice to limit flow of the hydraulic fluid between that end of the spool and the reduced pressure at the input port of the solenoid valve. These are selected to achieve a smooth transition of the spool to its null position. First a spool transition orifice is operative to control flow of fluid at one rate, and then, as the servo valve spool approaches its null position, a null override orifice is operative to reduce flow further, until the spool reaches its set position.

The positioner includes a stem that projects axially towards the associated end of the servo valve spool. When the positioner is in its closed position, this stem meets the end face of the servo valve spool when the latter is in its null position. The positioner has a positioner transition land that is open to a flow of fluid from the hydraulic actuator to a positioner transition port that communicates with the solenoid valve input port through a positioner transition orifice. A positioner transition land closes the positioner transition port after a predetermined travel. There is also a relief passage communicating between the hydraulic actuator or piston and the solenoid valve input port, and this relief passage has interposed therein a positioner null override orifice. The positioner transition orifice and the positioner null override orifice have orifice sizes that achieve a smooth movement of the positioner as it pushes the spool member through its null position to its set position.

The affect of this mechanism is to move the servo valve spool in a controlled fashion to its set position as soon as the solenoid valve of the deceleration control mechanism is actuated, i.e., when its control current goes low. The movement of the positioner in its associated sleeve or bushing is designed to achieve a constant deceleration in the subsequent actuator stage that is controlled by the servo valve, so as to keep the acceleration or deceleration of the actuator below some acceptable maximum, i.e., below about 0.4 g.

The above and many other objects, features, and advantages of this invention will become more fully understood from the ensuing description of a preferred embodiment, which should be read in connection with the accompanying drawing.

DETAILED DESCRIPTION OF THE PREFERRED EMBODIMENT

Figure 1:
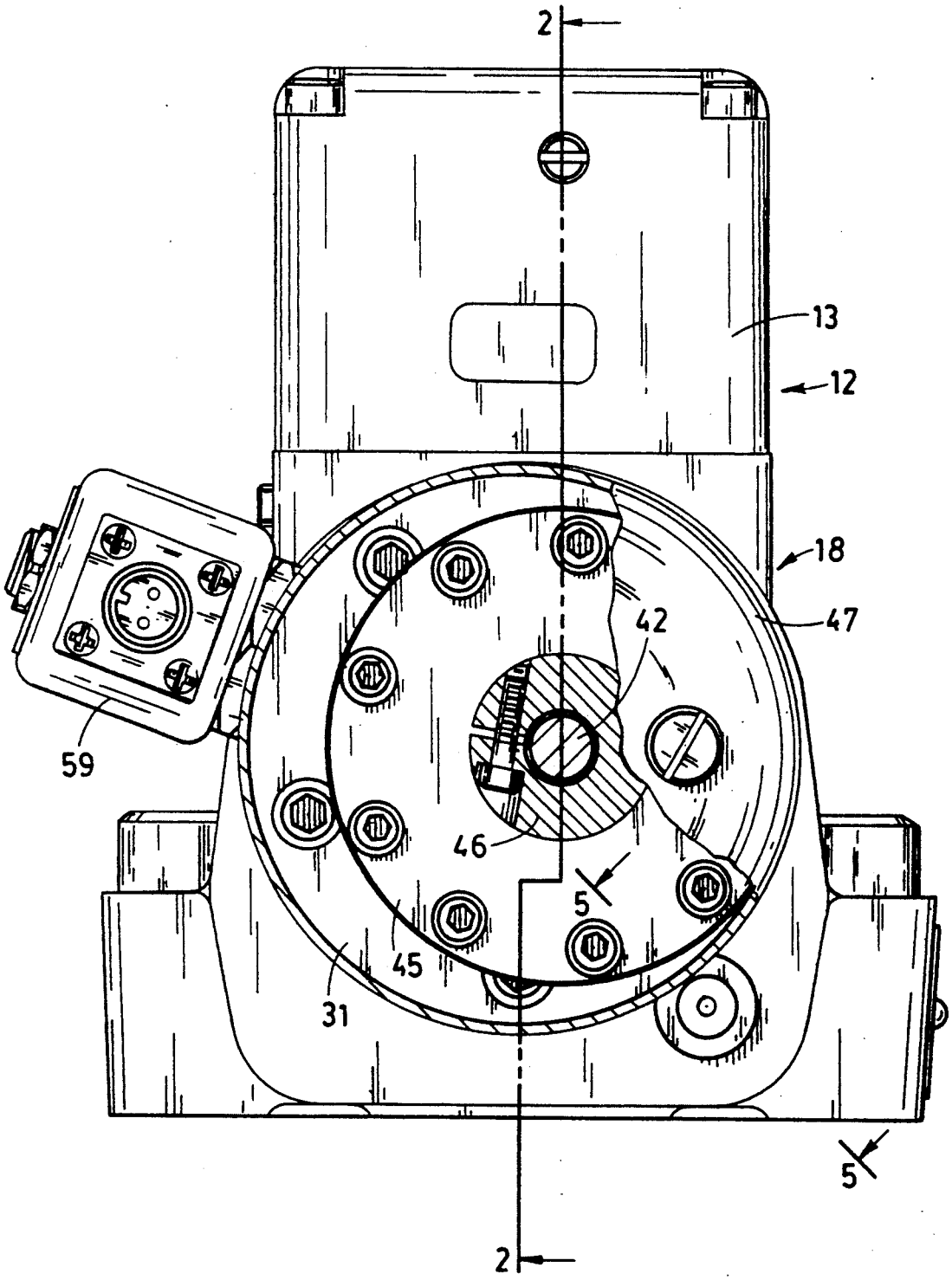
FIG. 1 is an end view partly cut away of a servo valve assembly which incorporates a deceleration control mechanism according to one preferred embodiment of this invention.
Figure 2:
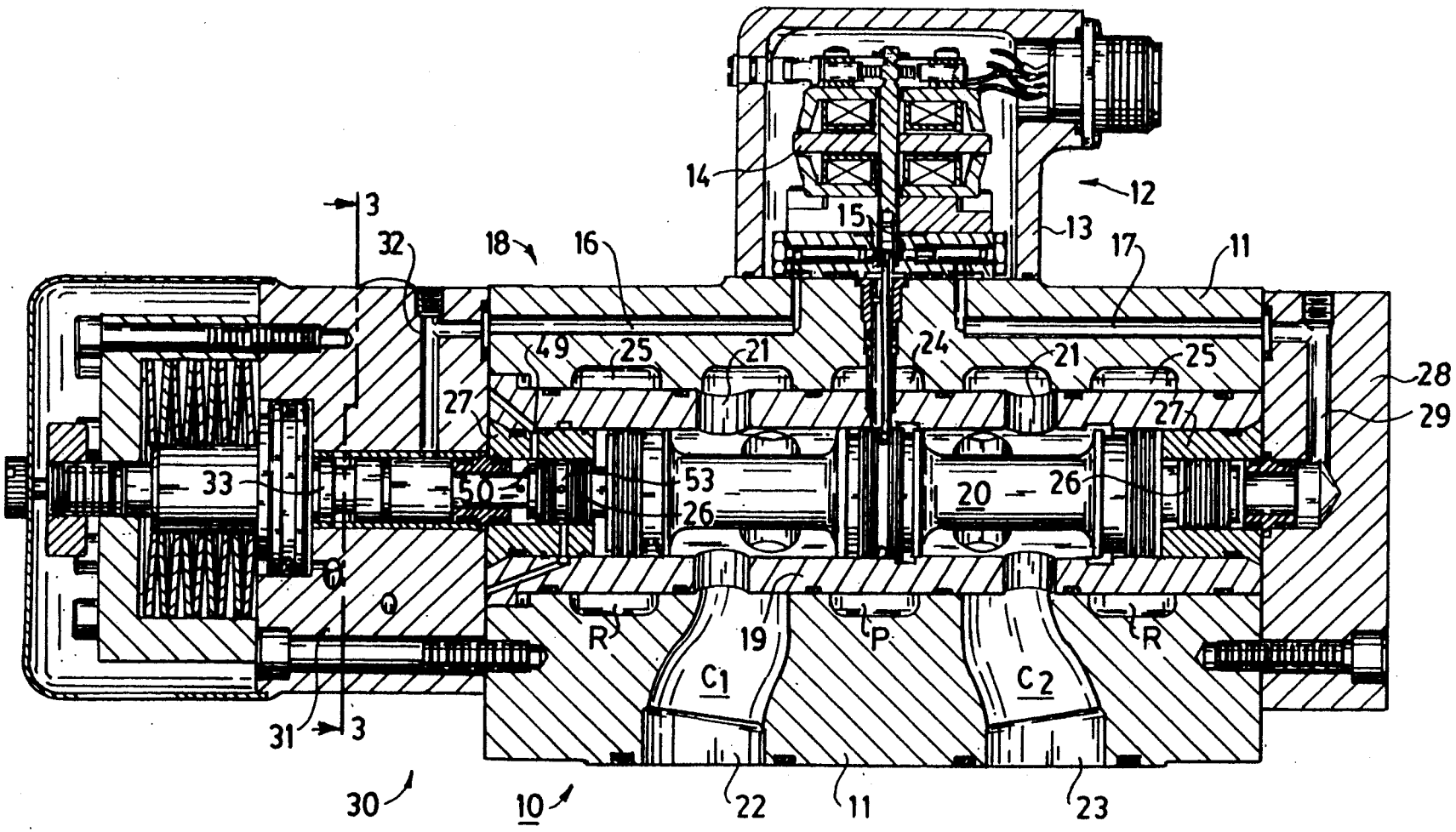
FIG. 2 is a sectional elevation taken along line 2—2 of FIG. 1.

With reference to the Drawing, and initially to FIGS. 1 and 2, a two stage servo valve assembly 10 has a valve body 11 on which is mounted a first stage 12 or hydraulic amplifier. A first stage 12 has a housing 13 in which is positioned a torque motor 14 that has a flapper valve 15 that supplies proportional fluid pressures $A_1$ and $A_2$ through amplifier output channels 16 and 17. The fluid amplifier pressures $A_1$ and $A_2$ control a second stage 18 disposed within the valve body 11 below the first stage 12. In the second stage, a cylindrical sleeve or bushing 19 contains a servo valve spool 20, both of which are of a well-known design. The bushing has the number of output ports 21, which supply control fluid pressures $C_1$, $C_2$ at controlled flow rates through respective control channels 22 and 23. The control pressures $C_1$ and $C_2$ are applied to a subsequent actuator stage, not shown. The pressures and flow rates appearing at the control output channels 22 and 23, depend on the positions of respective lands on the spool 20 and cooperating ports o the bushing 19 which communicate with a pressure chamber 24 and one or more return or drain chambers 25. In a preferred embodiment, the pressure chamber 24 is supplied with fluid pressure at high pressure while the return pressure R appearing at the return chambers is kept to a minimum.

In this embodiment, there are stub shafts 26 at left and right ends of the spool 20 which are fitted within respective inner bushings or sleeves 27. The stub shafts 26 serve as reciprocating pistons to position the spool 20 within the bushing 19. In the normal mode, the amplifier channels 16 and 17 from the first stage 12 are coupled to the respective left and right ends of the spool 20, to wit, two outer faces of the stub shafts 26. To achieve this, there is an end cap 28 affixed onto the right-hand side, as shown in FIG. 2, containing a fluid channel 29 that communicates amplifier fluid pressure $A_2$ to the right-end stub shaft 26 of the spool 20.

A controlled disengagement valve assembly 30 is mounted on the left-hand side of the servo valve body 11, as shown in FIG. 2. Details of this mechanism are further illustrated with reference to FIGS. 3, 4, 5, and 6.

The controlled disengagement valve assembly 30 has an end-cap body 31 which attaches onto the left end of the valve body 11, and contains a fluid channel which, under normal conditions, functions to the same effect as the channel 29 of the end cap 28. The channel 32 normally communicates amplifier fluid pressure $A_1$ from the channel 16 to the left-side stub shaft 26. Within the body 31 is a spindle-type positioner 33 which is slidably mounted within a sleeve 34 or bushing that is, in turn, fitted within an axial bore in the body 31. A distal stem 35 on the positioner 33 protrudes to the right, in FIGS. 2 and 4, to abut the position of the end face of the stub shaft 26. Proximally of this stem 35 is an amp port shut-off land 36 which opens or closes an amplifier port 37 of the sleeve 34. This port 37 communicates with the channel 32. In an actuated or withdrawn position of the positioner 33, the land 36 is positioned proximally, i.e. to the left, of the amplifier port 37 and permits open flow of the amplifier fluid from the first stage 12, through the channels 16 and 32, to the piston face of the stub shaft 26. However, in the distal or closed position, of the positioner 33, as here shown the land 36 obstructs the port 37 and thus cuts off the first stage hydraulic amplifier from this end of the spool. A positioner transition land 38, as better shown in FIG. 6, cooperates with a positioner transition orifice 39 in the sleeve 34 to admit flow of fluid pressure to or from an actuator piston 40 formed on the positioner 33. A positioner null orifice 41 communicates directly with a chamber of the piston 40. This positioner null orifice 41 is more restrictive than the positioner transition orifice 39.

Also shown on the positioner 42, and proximal of the piston 40, is a positioner shaft 42 onto which are stacked a series of springs 43. These springs 43 are clamped down by a washer 44 that is in turn retained within a cup-shaped spring housing 45 that is bolted onto the body 31. A lock collar adjusting nut 46 is positioned on a projecting threaded end of the shaft 42. The lock collar nut 46 permits adjustment of final set position of the positioner. A metal cover 47 is secured onto the assembly 30 over the spring housing 45. In this embodiment, the springs are selected so as to have a sufficient spring force to overcome the fluid force on the spool 20.

In this embodiment there is provided an opening 48 in the stem 35 to communicate fluid pressure to the end of the stem through an axial bore.

Figure 6:
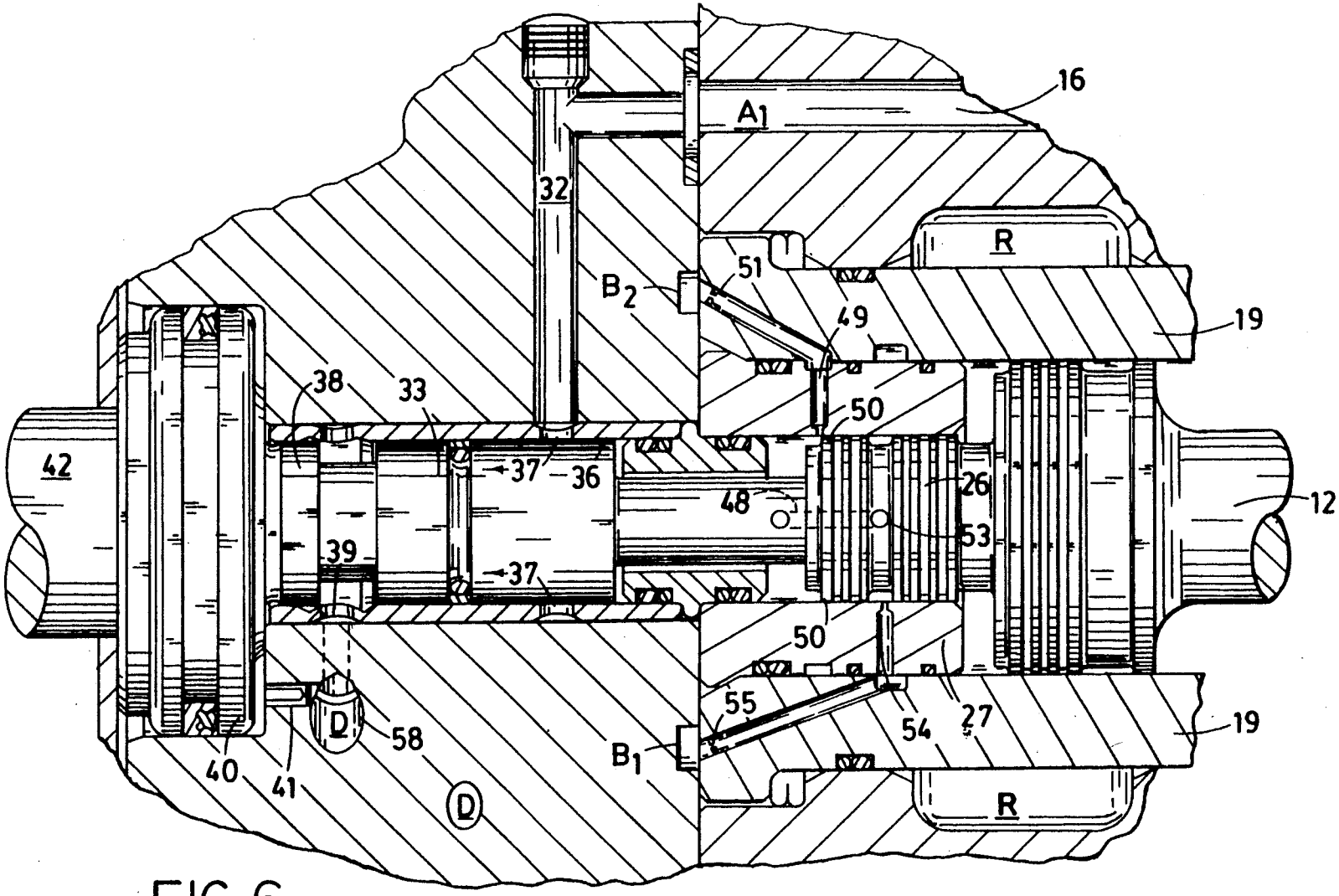
FIG. 6 is an enlarged view showing a portion of a deceleration control mechanism as illustrated in FIG. 2.

As shown in more detail in FIG. 6, the sleeve 27 is provided with a spool transition port 49 which faces a spool transition land 50 at the proximal (left) end of the cooperating stub shaft 26. Fluid escaping from this through the spool transition port 49 passes through a spool transition orifice 51.

Figure 3:
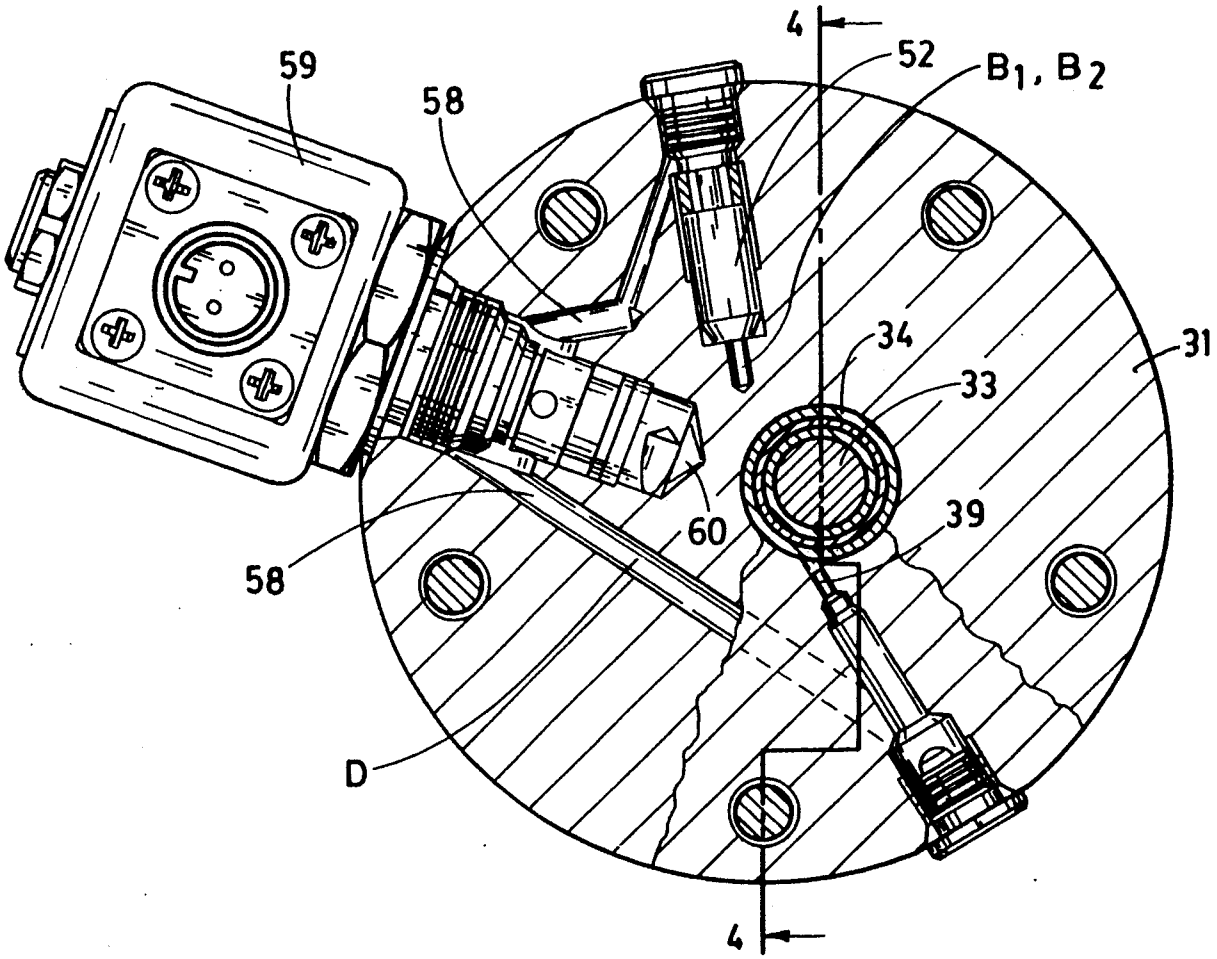
FIG. 3 is a cross sectional view of the deceleration control mechanism, taken at 3—3 of FIG. 2.
Figure 4:
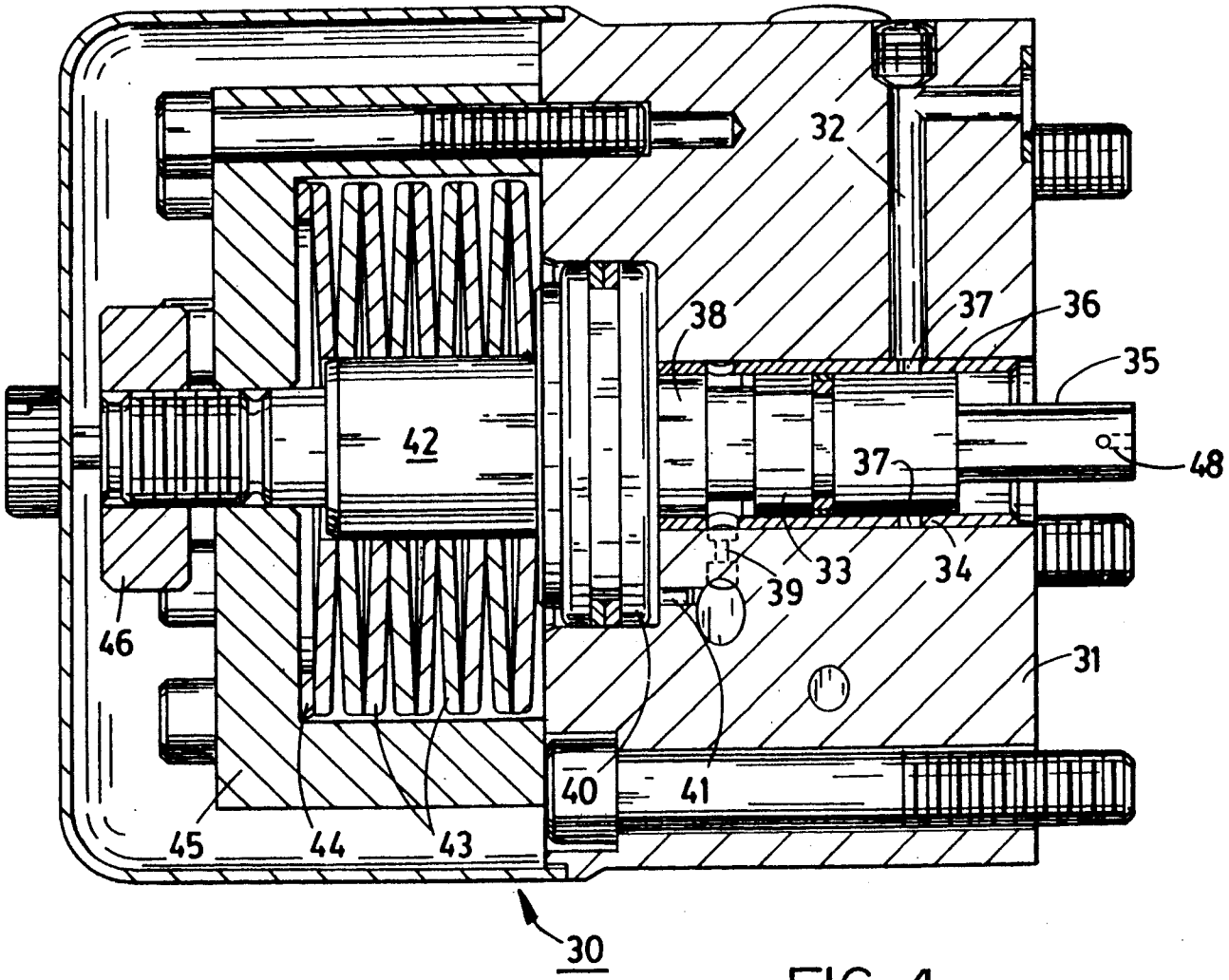
FIG. 4 is an enlarged cross sectional view of the deceleration control mechanism, taken at line 4—4 of FIG. 3.

This fluid, which is at a pressure $B_1$, then passes through a check valve 52, as shown in FIG. 3. The check valve is provided to prevent the spool transition port 49, land 50, and orifice 51 from interfering with normal operation of the servo valve.

There is also a null override opening 53 provided at one or both sides of the stub shaft 26, and this communicates with another axial bore through to the piston face of the stub shaft 26. This null override opening 53 is guarded by a number of lands on the stub shaft 26. A null override port 54 in the sleeve 27 is in fluid communication with the null override opening 53 when the spool 20 approaches its null position. The port 54 is provided with a null override orifice 55 to permit flow of fluid at a controlled rate and at a pressure $B_2$ through the check valve 52 (FIG. 3).

The null override orifice 55 is more restrictive than the spool transition orifice 51.

Figure 5:
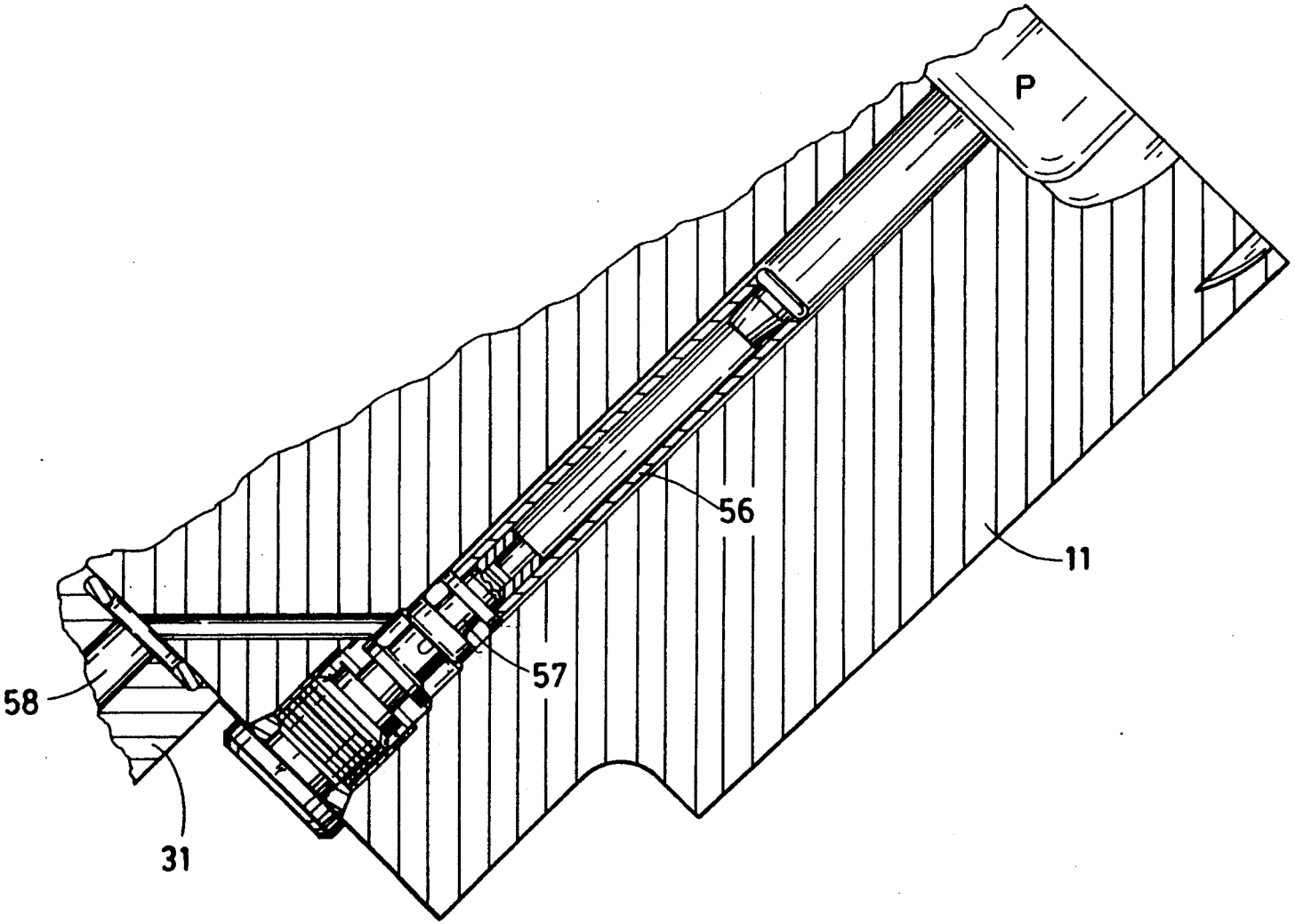
FIG. 5 is a detailed cross sectional view, taken at 5—5 of FIG. 1.

As shown in FIG. 5, high pressure fluid is fed through a fluid filter 56 and a dropping orifice 57 into a fluid conduit 58 within the body 31. Returning to FIG. 3, the conduit 58 is coupled to an input side of a solenoid valve 59. The solenoid valve 59 is normally energized to a closed position, but in the event of loss of signal, the valve opens to connect the conduit 58 to another channel 60 which is at drain or return pressure, Thus, in the conduit 58, there is a fluid pressure D which is normally the supply pressure. However, in the event of a failure mode, in which the solenoid valve opens, the pressure D drops to a low pressure near the return pressure. As is also shown in FIG. 3, the spool transition orifice 51 and spool null override orifice 53 communicate through a check valve 52 with the conduit 58. The check valve 52 permits fluid flow only when the pressure D is low, that is, only when the solenoid valve 59 is open.

In normal operation, solenoid valve 59 is actuated closed, and the pressure D appearing in the conduit 58 is the supply pressure. Full fluid pressure is then applied to the positioner piston 40, and the piston force overcomes the force of the springs 43 and urges the positioner 33 to its open position. This allows unobstructed fluid communication between the first stage amplifier channel 16 and the left hand side of the spool 20.

In a failure mode, the solenoid 59 is deenergized, which reduces the pressure D in the conduit 58. The spring force from the springs 34 is then higher than the fluid force against the piston 40, and the springs 43 urge the positioner quickly to the closed position (i.e. to the right). The land 36 then obstructs the amp port 37 to disconnect the fluid path from the channels 16 and 32. If the spool 20 is in the position represented at the far left in FIG. 2, the positioner 33 is operative to push against the spool 20 so that stem 35 urges the stub shaft 26 rightward, until the spool 20 reaches its set position. Initially, fluid exits from the piston 40 through the positioner transitioner orifice 39. However, once the positioner transition land 38 has transisted sufficiently to cut off flow through this orifice 39, the remaining flow from the piston 40 is through the positioner null orifice 41 which is at a lower flow rate.

Figure 7:
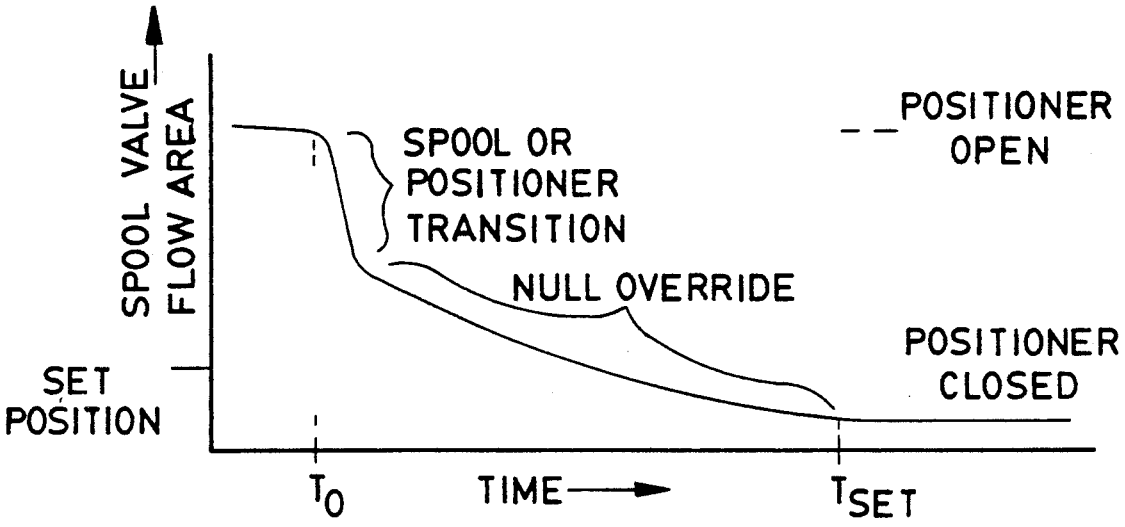
FIG. 7 is a chart showing the gradual change of spool valve port area as a function of time after actuation of the deceleration control mechanism of the invention.
Figure 8:
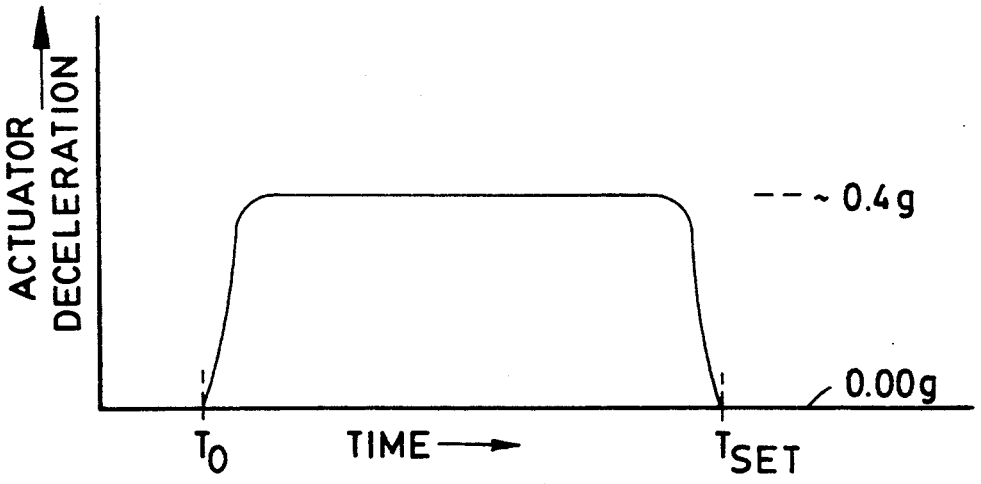
FIG. 8 is a chart showing subsequent stage deceleration as a function of time.

As shown in FIG. 7, the effect of this motion of the positioner 33 on the spool 20 is a gradual closing of the ports in the bushing 19 as the spool 20 moves towards its null position. The combined effect of the positioner transition and null override orifices is to yield a generally parabolic curve. The effect of this is to achieve as closely as possible a constant deceleration from the initiation of failure mode at a time $T_0$ until the spool 20 reaches it null position at a time $T_{set}$. Preferably, acceleration is kept below a maximum acceptable level.

In the event that the spool 20 is at its rightmost or distal position when a failure mode is encountered, the positioner 33 will move to its closed position, as previously described. This cuts off the amplifier stage pressure from the amp channels 16 and 32 to the stub shaft 26. Fluid pressure remaining in amp channels 17 and 29 drives the stub shaft 26 and spool 20 towards the null position due to the pressure imbalance between the stub shaft ends. Fluid now begins to flow out through the spool transition orifice 51. Then, as the spool 20 approaches its null position, the spool transition land 50 cuts off flow through the orifice 51, and the fluid flow proceeds through the null override orifice 55. These two orifices 51 and 55 are selected so as to achieve control characteristics such as shown in FIG. 7, to bring the spool 20 gradually to its null position and to make deceleration effects on any subsequent stages as gentle as possible. In either event, in the failure mode the spool 20 is brought to its set position and is halted there. The pressure in amp channel 29 firmly loads the spool 20 against the spring load remaining in the positioner 33. There is no hunting or ringing about the set position. Consequently, no further vibration occurs in the subsequent or following stages. In the set position, the positioner stem 35 lodges against the end of the spool 20. The adjusting nut 46 permits adjustment of the positioner for the set point.

While the present invention has been described in detail with respect to one preferred embodiment, it should be understood that the invention is not limited to that precise embodiment. Also, in this description terms of direction or orientation are given simply to assist in understanding the illustrated embodiment. These terms, such as left, right, upper, above and below, should not be construed as limitative. Many modifications and variations of the above-described embodiment will be apparent to those of skill in the art such as alternate type first stage amplifiers or multistage spool drivers, without departing from the scope and spirit of this invention, as defined in the appended claims.

What is claimed is:

1. A hydraulic servo valve arrangement comprising a hydraulic amplifier stage supplied with a control signal and having a high-pressure port coupled to a source of hydraulic fluid provided at a high pressure and a return port coupled to a drain which withdraws the hydraulic fluid therefrom at a low pressure, and first and second amplifier ports which provide hydraulic fluid at respective controlled amplifier pressures between said high and low pressures and which vary as a function of said control signal; a fluid valve stage including a spool member slidably disposed within a bushing member that has a generally cylindrical interior surface and which is penetrated by a plurality of openings through which fluid selectively flows depending on position of said spool member within said bushing member, the spool member including a plurality of lands that define, in conjunction with said openings, metering orifices to control flow of said fluid, and a valve body containing said bushing member and having pressure and return channels formed therein which couple respective ones of said openings in said bushing member to said source and said drain, first and second control channels coupled to other respective openings in said bushing member to deliver said fluid at respective first and second control fluid pressures which depend on the position of said spool member within said bushing member and wherein, in a central null position of said spool member, the first and second control fluid pressures are in balance, and first and second amplifier fluid channels which communicate the control amplifier fluid pressure from said first and second amplifier ports to respective first and second ends of said spool member to urge said spool member to move in a fashion to follow said amplifier fluid pressures; and a deceleration control mechanism interposed in said first amplifier fluid channel including positioner means having first and second positions respectively permitting and blocking flow of said fluid between said first amplifier port and said first end of said spool, hydraulic actuator means for urging said positioner means into its first position, resilient biasing means for urging said positioner means into its second position; solenoid valve means having a control signal input, an input port coupled through a dropping orifice to said supply and a second port coupled to said drain, such that in an actuated condition the input port is at said supply pressure but in an unactuated condition the input pressure port drops to a low pressure; said hydraulic actuator being in fluid communication with said solenoid valve input port; and at least one relief channel disposed in fluid communication with said first end of said spool member and with said solenoid valve input port, each said relief channel having a metered orifice to limit flow of said hydraulic fluid between said first end of the spool member and said solenoid valve input port to achieve smooth transition of said spool to its null position.

2. A hydraulic servo valve arrangement according to claim 1 wherein said first end of said spool member includes a piston having an outer land and a groove displaced from said outer land, and said at least one relief channel includes a spool transition channel having a port facing said piston and exposed by said land when said spool member is displaced from said null position but is closed thereby as said spool member approaches said null position, and a null override channel which is opened to said groove when said piston approaches said null position.

3. A hydraulic servo valve arrangement according to claim 2 wherein said spool transition channel and said null override channel include a spool transition orifice and a null override orifice, respectively, which provide different respective flow rates.

4. A hydraulic servo valve arrangement according to claim 3 wherein said piston includes a channel communicating between said groove and an end face of the piston.

5. A hydraulic servo valve arrangement according to claim 1 wherein said positioner includes a stem protruding axially substantially to said first end of the spool member when said positioner is in its second position.

6. A hydraulic servo valve arrangement according to claim 5 wherein said positioner has a positioner transition land which is open to flow of fluid from said hydraulic actuator through a positioner transition port in communication with said solenoid valve input port through a positioner transition orifice, and said positioner transition land closing said positioner transition port after a predetermined travel; said deceleration control mechanism further including a relief passage communicating between said hydraulic actuator and said solenoid valve input port and having interposed therein a positioner null override orifice, said positioner transition orifice and said positioner null orifice having respective sizes to achieve smooth movement of said positioner to push said spool member to its null position.

* * * * *